United States Patent [19]

Maiorana

[11] 4,146,042

[45] Mar. 27, 1979

[54] SMOKING PIPE AND LIGHTER SYSTEM

[76] Inventor: Russell J. Maiorana, 106 Motor Ave., South Farmingdale, N.Y. 11735

[21] Appl. No.: 808,608

[22] Filed: Jun. 21, 1977

[51] Int. Cl.[2] ..... A24F 3/00; A24F 47/00

[52] U.S. Cl. ..... 131/185; 131/225; 131/226

[58] Field of Search ..... 131/185, 186, 225, 226, 131/211, 7

[56] References Cited

U.S. PATENT DOCUMENTS

| | | | |
|---|---|---|---|
| 2,210,199 | 8/1940 | Blum | 131/226 |
| 2,532,820 | 12/1950 | Pelt | 131/185 |
| 2,549,726 | 4/1951 | Van Toll | 131/185 |
| 2,578,061 | 12/1951 | Greenblatt | 131/185 |
| 2,595,534 | 5/1952 | Nicholson et al. | 131/185 |
| 2,648,879 | 6/1953 | Quiroz | 131/186 X |

*Primary Examiner*—Stephen C. Pellegrino

*Attorney, Agent, or Firm*—Eisenman, Allsopp and Strack

[57] ABSTRACT

A uniquely designed smoking pipe having a removable lighter mounted within the body of the pipe itself. The pipe components and design provide cleaning features, a variable volume tobacco bowl, and compatible use of the pipe with the lighter unit.

8 Claims, 4 Drawing Figures

SMOKING PIPE AND LIGHTER SYSTEM

BACKGROUND OF THE INVENTION

1. Field of the Invention

This invention relates to smoking implements, and more particularly to a smoking pipe provided with an integral chamber for carrying a conventional flammable liquid lighter. Among pipe smokers, one of the most essential and demanding functions is that of lighting and relighting the tobacco. Typically this is done either with matches or flammable liquid devices known commonly as "cigarette lighters". Since the typical pipe is quite large and frequently requires a hand for support, the smoker often has to perform considerable digital manipulations in order to light the tobacco within the bowl of the pipe. While this chore is common and accepted by most pipe smokers, it is nevertheless desirable to render the task more convenient.

A number of prior pipes have been suggested, wherein matches or flammable liquid lighters are provided either for attachment to pipes, or actually integral parts thereof. All such devices must obviously consider the problem of supporting such elements in close proximity to the heated and burning tobacco bowl. Furthermore, the added weight of such lighters must be arranged so that no undue burden is placed upon the smoker.

Typically, one also finds pipes designed for removal of portions of the stem in order to permit cleaning of the tobacco and smoke residue which builds up during use. The techniques for removal of these elements and the particular elements involved, vary depending upon each pipe design.

SUMMARY OF THE INVENTION

According to the present invention, there is provided a uniquely designed pipe with a cavity for supporting a flammable lighter unit. The unit may be removed at will and is positionable to permit quick and convenient ignition of the tobacco in an adjacent bowl, without removal from its nesting position.

It is an object of the invention to provide an improved smoking pipe.

Another object of the invention is to provide a smoking pipe-lighter combination wherein the lighter is easily removable; but may remain in position as an integral part of the pipe itself, for as long as it contains lighter fluid.

Another object of the invention is to provide a smoking pipe having a varying volume bowl and a lighter positioned in proximity to said bowl; the lighter and bowl combination being movable in order to assure that the lighter can conveniently ignite the contents of the bowl with a minimum draw on the part of the smoker.

Yet another object of the invention is to provide an improved smoking pipe design that may be manufactured in mirror image molds of the thermosetting heat-conductive flame retardant materials.

In accordance with one embodiment of the invention, the smoking pipe comprises an integral housing having first and second chambers disposed at one end thereof. The first of said chambers is adapted to hold a conventional flammable liquid lighter with the wick thereof projecting above the pipe itself. The second chamber is adjacent to the first and supports a tobacco bowl of variable volume such that the contents may be ignited by said lighter by inhaling through said bowl. A pipe stem is coupled to said bowl at right angles.

A complete understanding of the invention, an appreciation of its features, and the manner in which the above objects are attained, will be available from the following description that is made in conjunction with the drawings.

DESCRIPTION OF THE PREFERRED EMBODIMENT

Figure 1:
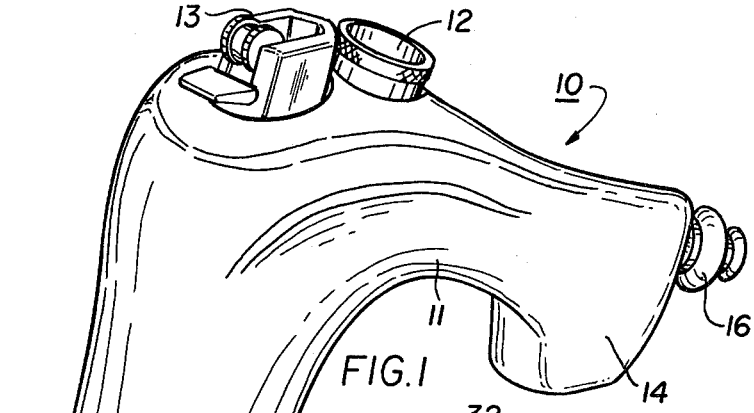
FIG. 1 is a perspective view of a pipe-lighter unit embodying the invention.

The perspective view of FIG. 1 shows the pipe-lighter device 10 to comprise the housing unit 11 with bowl portion 15 and stem portion 14. The bowl portion is divided up to support both a lighter 13 and the bowl 12. With the stem portion, a conduit extends from the mouthpiece 16 to the bowl 12 in order to provide a basic passage. The body of the unit is enlarged in order to properly support the lighter and bowl installation and may be designed in a number of ways to render the unit most comfortable to the hand.

Figure 3:
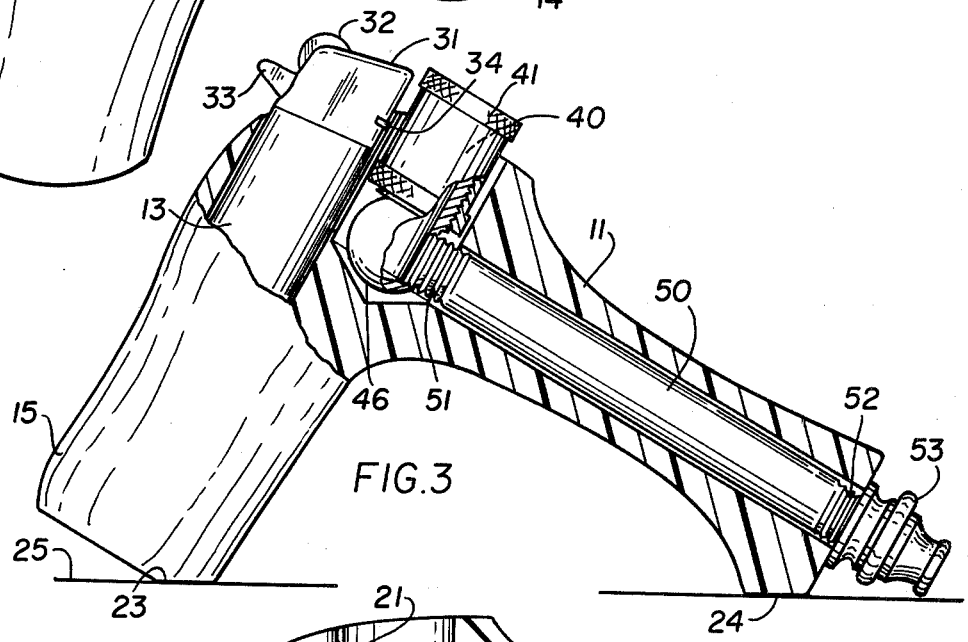
FIG. 3 is a side elevation of the pipe-lighter unit of the embodiment shown in FIG. 1, with portions removed in order to disclose details of the various elements.
Figure 2:
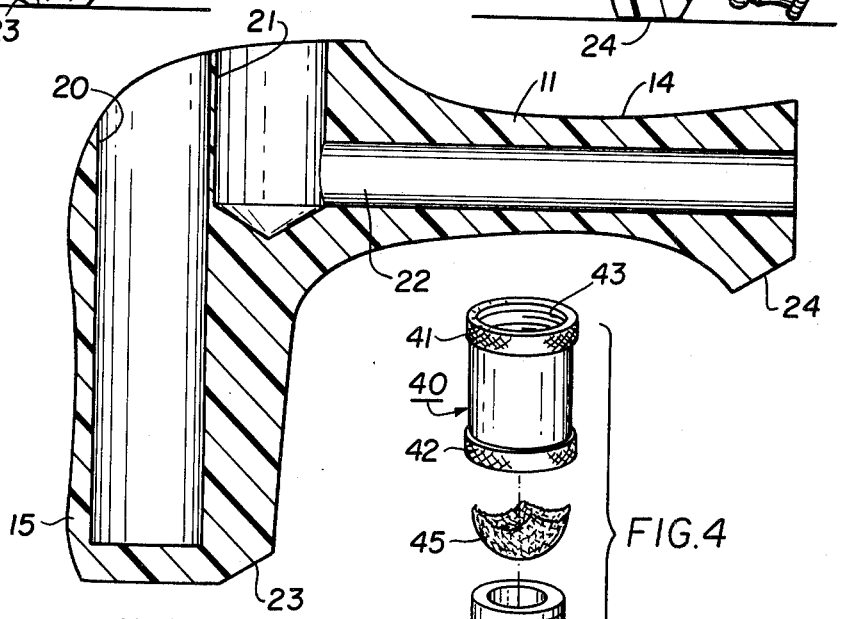
FIG. 2 is a vertical cross-section taken along the axis of the unit shown in FIG. 1, with interior smoking elements removed.

The actual design may be most readily appreciated by considering FIGS. 2 and 3. The first of these Figures is simply a vertical cross-section taken along the axis of the pipe. In the cross-section, the lighter, bowl, and stem elements have been removed to disclose a semi-cylindrical lighter cavity 20, a semi-cylindrical bowl cavity 21 and a stem cavity 22. A partition or wall separates lighter cavity 20 from the bowl cavity 21 in order to provide a heat conductive barrier.

If one wishes to mold this pipe, FIG. 2 would represent one half of the mold and its mirror image would represent the second half of the mold. Joining these halves would create a complete unit suitable for the seating of the various pipe elements.

FIG. 3 is a broken-away view illustrating the actual location of the pipe elements. Thus, the cigarette lighter 30 is in position within cavity 20. It includes a flammable liquid cartridge 30; the lighter head within which a wick (not shown) is mounted; an abrasive wheel 32 and valving member 33 for use in lighting and retaining the flame. Still further, standard element 34 is provided for increasing the wick exposure and flame height as desired. The lighter 13 is force fitted into cavity 20 and the relative dimensions of the lighter and cavity are such that it will remain in position until pried out under mild pressure on the part of an operator.

FIG. 3 also reveals the smoking elements comprising pipe bowl 40, the pipe stem 50, and the lower coupling element 46 interconnecting the pipe bowl and stem. All elements are threaded in order to permit assembly and disassembly. Pipe stem 50 is provided with an external thread 51 on the bowl end and an external thread 52 on the mouthpiece end. It is of appropriate length to tighten coupling element 46 against the side wall of the bowl chamber 21, when the mouthpiece element 53 is screwed on to the remote end of the pipe stem. Element 53 is provided with a flange which bears against the pipe housing itself and therefore assures a clamping of these elements in a rigid position.

Figure 4:
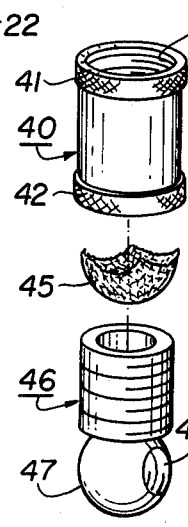
FIG. 4 is an exploded view of the tobacco bowl element, revealing the manner in which variable volume is achieved.

FIG. 4 illustrates the manner in which bowl 40 may be enlarged to increase the tobacco capacity of the pipe. In this exploded view, the coupling 46 is revealed to have an external upper thread 48 that engages with a cooperating inner thread 43 of the pipe bowl. A screen or tobacco supporting element 45 rests upon the top surface of coupling element 46. Accordingly, as the pipe bowl is screwed down over threads 48, the volume within bowl 40 is diminished.

It will also be apparent that the lower portion of coupling element 46 has an internal threaded cylindrical chamber whose threads 49 receive the pipe stem 50.

In order to operate this lighter-pipe combination, a smoker simply flips abrasive wheel 32 and holds his finger upon lever 33 in order to ignite the wick. With the wick ignited, the smoker inhales drawing air through the tobacco in bowl 40, coupling element 46, and stem 50. This inhalation draws the flame downward to the tobacco and effects the desired lighting. By keeping cavity 20 carefully dimensioned to the side walls of the lighter 13, one is able to modify the height of the lighter vis-a-vis the top of bowl 40, in order to insure proper drawing of the flame. Furthermore, when bowl 40 is elevated in order to create a larger volume therein, one may also wish to raise the cigarette lighter to insure proper lighting.

Though not necessary, it is desirable to have bowl 40 loosely fitted within chamber 21. This permits circulation of air between the bowl and basic pipe housing in order to enable its removal, rotation, and cooling.

It will be noted that the view of FIG. 3 shows pipe 10 tilted. In this position, surfaces 23 and 24 rest upon the flat surface 25 and prevent tipping of the pipe. Thus, the user need not concern himself with maintaining the pipe properly positioned to hold any possible tobacco that may be within the bowl.

The invention has been described using a specific form. It should be understood that those skilled in this art may desire to modify this form for particular purposes. The scope of the invention is defined by the appended claims and all structures coming within the spirit and scope of these claims are intended to be covered thereby.

What is claimed is:

1. A smoking pipe comprising a housing with an elongated bowl end projecting orthogonally from the axis of a stem end; a first compartment within said housing at the bowl end, supporting a removable lighter element; a second compartment adjacent and separated from said first compartment, supporting a tobacco chamber; a hollow conduit coupled to the tobacco chamber and extending along said axis of stem end; and a mouthpiece coupled to the remote end of said conduit; a right angle coupling member between said tobacco chamber and said conduit, and screen means interposed betwen said coupling member and said tobacco chamber; said tobacco chamber being fastened to said coupling means whereby the volume within said chamber can be varied.

2. A smoking pipe as defined in claim 1, said tobacco chamber being threaded to said coupling means whereby the volume within said chamber is varied upon rotation thereof.

3. A smoking pipe as defined in claim 1, including means for vertically adjusting the flame height from said lighter element to select the height desired relative to the tobacco chamber.

4. A smoking pipe as defined in claim 1, wherein said coupling member, said conduit, and said mouthpiece are threaded together to effect a clamping thereof within said housing.

5. A smoking pipe as defined in claim 1, wherein the lowermost portions of said bowl and said hollow conduit, are structured to lie within a common plane so that the housing will rest upright and unsupported upon a planar surface while keeping said mouthpiece above said planar surface.

6. A smoking pipe as defined in claim 1, wherein said housing is symmetrical about a plane extending vertically through the center thereof.

7. A smoking pipe as defined in claim 1, wherein said housing is formed of rigid head conductive material.

8. A smoking pipe as defined in claim 1, wherein the outer diameter of said tobacco chamber is less than the inner diameter of said second compartment.

* * * * *